United States Patent [19]

Muselaers

[11] 4,384,521

[45] May 24, 1983

[54] ROTARY SCREEN PRINTING MACHINE

[75] Inventor: Cornelis Muselaers, Boxmeer, Netherlands

[73] Assignee: Stork Brabant B.V., Boxmeer, Netherlands

[21] Appl. No.: 191,256

[22] Filed: Sep. 26, 1980

[51] Int. Cl.[3] ..... B41L 13/04

[52] U.S. Cl. ..... 101/116

[58] Field of Search ..... 101/116–120; 118/213, 301; 192/43.1

[56] References Cited

U.S. PATENT DOCUMENTS

| | | | |
|---|---|---|---|
| 2,394,429 | 2/1946 | Crosmon | 192/43.1 |
| 3,420,167 | 1/1969 | Van Der Winden | 101/116 |
| 3,670,855 | 6/1972 | Lemery | 192/43.1 |
| 3,910,184 | 10/1975 | Springer | 101/116 |
| 3,934,502 | 1/1976 | Marino | 101/116 X |

*Primary Examiner*—A. J. Heinz

*Attorney, Agent, or Firm*—Irving M. Weiner; Pamela S. Burt; John L. Shortley

[57] ABSTRACT

In a rotary screen printing machine, which comprises a frame and at least one cylindrical stencil with end rings, each of which is rotatably mounted within a bearing on the frame. At least one of these end rings is provided with driven memebers for rotating the respective stencil. A coupling maintains a driving connection between the driven members, and a stop is operable upon the coupling to break the driving connection between the driven members for rendering the drive force of the driven members inactive during the printing operation, thus arresting the respective stencil. The stop subsequently can be actuate to permit a restoration of the said drive force. The provision according to the present invention thus allows a rapid addition or removal of one or more pattern portions of a design to be printed during the printing operation without any loss of time and material.

2 Claims, 3 Drawing Figures

ROTARY SCREEN PRINTING MACHINE

BACKGROUND OF THE INVENTION

1. Field of the Invention

The present invention relates to a rotary screen printing machine, comprising a frame, and at least one cylindrical stencil provided with end rings which are each rotatably supported in a bearing of said frame, at least one of these two end rings being provided with driven members for rotating the supported stencil.

2. Description of the Prior Art

In a machine of this kind, which has been used in the art, one or more rotating stencils should occasionally be brought to a standstill in a simple manner. Said stationary stencils should preferably be rerotated while maintaining register with respect to the other stencils or to the pattern already printed, without stopping the entire machine.

So far, however, such a possibility did not exist in practice.

SUMMARY OF THE INVENTION

In view of the foregoing factors and conditions of the prior art it is a primary object of the present invention to provide an apparatus which compensates these shortcomings.

According to the present invention, this object is attained in that at least one of the two supporting bearings is provided with means for rendering the drive force of the driven members inactive during the operation of the apparatus and for subsequently restoring the active drive connection.

Although the present invention is more particularly destined for application to positively driven stencils, the respective means may also be applied in a machine, provided with a frictional drive for the stencils. The drive force may then be made inactive by locking the stencil concerned. The present invention will ever be applicable, independent of the fact whether the stencils are driven on one side or at both extremities.

The present invention allows the addition or removal of one or more pattern portions of a design to be printed without loss of time and material which, according to the fashion prevailing at that moment, may be desirable or necessary. In an operating printing machine which comprises a number of unused printing positions, the present invention also allows for new stencils to be positioned for a subsequent design, without interrupting the operation, at the desired moment and without loss of time by disconnecting the stencils operating at that moment.

The present invention is specifically embodied in a screen printing machine in which one of the supporting bearings is provided with driven members whilst the other extremity of the stencil runs along freely.

In a machine of this type the said means are formed by a pin or cam which co-operates with a recess in one of the driven members, said pin being displaceable against a yielding force. The said pin or cam may, as a matter of course, be displaceable under the influence of a pneumatic or hydraulic force, but also by magnetic or mechanical means.

The present invention may also be applied in a screen printing machine in which, in a manner known per se, the rotatable part of the supporting bearing co-operating with the driven members is a sleeve, coupled with the respecting end ring. In such a machine the invention is applied if the cam is connected with the sleeve via a blade spring, said cam comprising a curved entering face. Furthermore, the frame is provided with a stop, displaceable between two positions which stop co-operates in its active position with an entering face for urging the cam out of the recess. It is observed that, principally, the stop may be displaced axially or radially.

In the embodiment according to the invention as described hereinbefore, the coupling between the sleeve and the driven members is interrupted without causing a positive locking of the respective stencil. In actual practice, however, the stencil will come to a standstill immediately upon interruption of the drive, whereupon the work aimed at can be carried out. After having withdrawn the stop again, said coupling is restored and the printing procedure is continued.

In an embodiment of the screen printing machine according to the invention, the entering face arranged to the cam, is provided with a notch which in a locking manner may co-operate with the extremity of the stop in its operative position, thus arresting the stencil concerned.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF PREFERRED EMBODIMENTS

Figure 1:
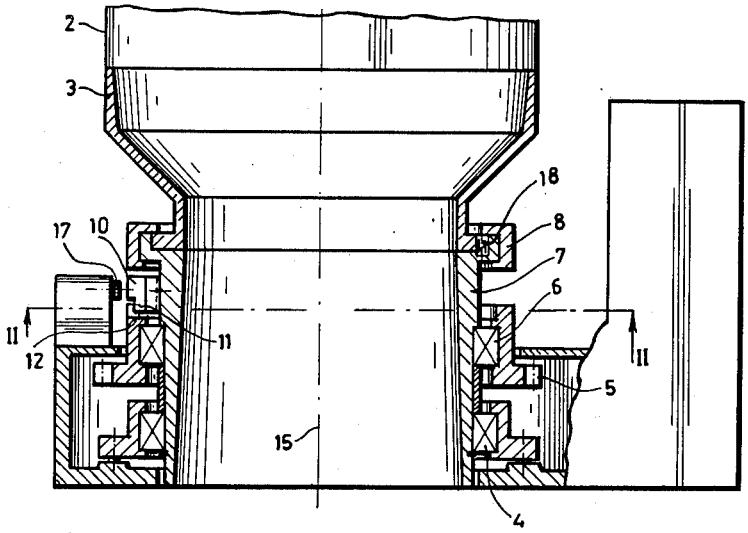
FIG. 1 is an axial section of a supporting bearing, provided with driven members, while also an extremity of a stencil is shown.

In order to best understand the present invention a description of preferred embodiments thereof is provided accompanied by drawings. In FIG. 1 the machine comprises a frame 1 in which at least one, but mostly a number of cylindrical stencils 2 is or are provided. At its extremities each stencil comprises an end ring 3 which is supported rotatably in a bearing 4 of the frame 1. The end ring 3 is provided with driven members for rotating the stencil 2. Only the pinion 5 of these members is shown, which pinion, via a bearing 6, rests on a sleeve 7 which is positioned coaxially in the continuation of the respective stencil 2 and the end ring 3. The sleeve 7 is clamped to the end ring 3 by means of a locking ring 8. The sleeve 7 is supported in frame 1 of the machine via the bearing 4.

Figure 3:
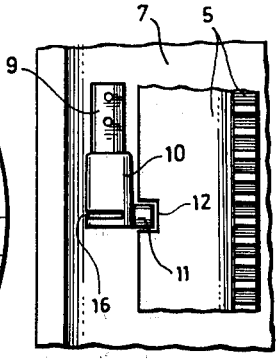
FIG. 3 is a detail of FIGS. 1 and 2 in front view.

The connection between pinion 5 and stencil 2 is realized via the sleeve 7. To this end a coupling means including blade spring 9 is fastened on this sleeve which on the free resilient part, comprises a curved entering face 10 (see also FIG. 3). Sideways of this face 10 a pin or cam 11 fits into a recess 12 of the pinion 5 (see also FIG. 3).

Figure 2:
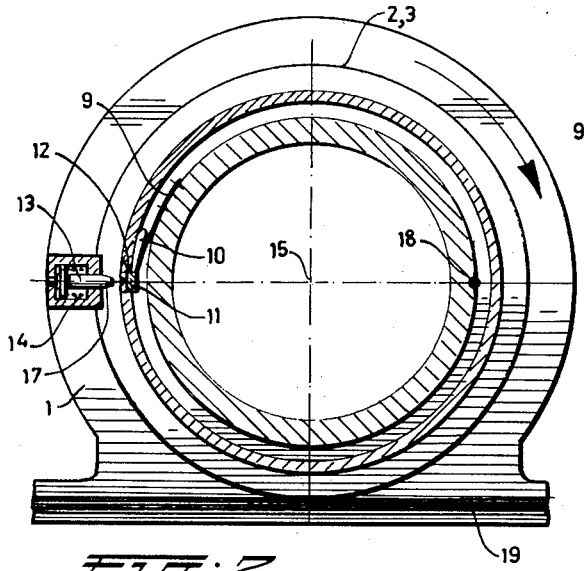
FIG. 2 is a cross section according to line II—II in FIG. 1.

Referring now to FIG. 2 frame 1 comprises an actuating means including a stop 13, displaceable between two positions, which stop in its active position co-operates with the entering face 10. In this manner cam 11 can be lifted out of the recess 12. A spring 14 urges the stop 13 into its inactive position, so that the cam 11 may slip back into the recess 12, and the active connection between the pinion 5 and the sleeve 7 be remade with the drive force of the pinion thus putting the respective stencil 2 into rotation.

If it is desirable to bring the respective stencil 2 selectively to a standstill, the stop 13 is moved toward the centerline 15 of the stencil, whereupon the entering face 10 moves along the stop, thus gradually urging the cam 11 out of the recess 12 against the force of the blade spring 9, so that the active connection between the pinion 5 and the sleeve 7 is interrupted and the stencil 2 comes to a standstill. The pinion 5 remains rotating and the cam 11 either stays entirely free from the pinion or slides along the inside thereof with a very slight friction.

The entering face 10 may be provided with a notch 16 which cooperates lockingly with the extremity 17 of the stop 13 in its active position, so that the respective stencil 2 is arrested, and no undesirable restoration of the drive will occur.

The mechanism for controlling the stop is not shown in further detail, but this may be effected in any known manner, such as mechanically, manually, pneumatically or hydraulically, and also electromagnetically. FIG. 2 also shows a pin 18 which is arranged in the sleeve 7 (FIG. 1). This pin 18 ensures that in all printing positions (stations) of the respective rotary screen printing machine the stencils can only be arranged in a predetermined position by means of the locking ring 8 (FIG. 1). Each stencil can therefore be brought into the right printing position as rapidly as possible. The material to be printed rests on an endless belt or printing blanket 19.

It is observed that the provision according to the present invention is applicable not only to rotary screen printing machines with a positive drive of the stencils, either at one side or at both extremities, but also in screen printing machines to which the stencils are driven via friction. In the latter case the means for rendering the drive force inactive, can also be arranged between the frame 1 and the sleeve 7 of the stencil. In that case the cam 11 is always kept in a free position during the printing operation and when the stencil is brought to a standstill, this cam contacts the recess concerned. Furthermore, it is observed that in the described embodiment the cam 11 is displaced radially, but an embodiment in which this cam is displaced axially, i.e. parallel with the center line 15, also comes within the scope of the invention.

The provision according to the present invention allows the addition or removal or one or more pattern portions in a design which is printed with a number of stencils, without loss of time and material, which is sometimes necessary, due to the varying demands of clothing industries. If the rotary screen printing machine is provided with a large number of printing stations only part of which is used for printing a certain design, the stencils of a subsequent design can be inserted during the operation of the available stencils and the new stencils may be taken into use, at any suitable moment and without loss of time, while simultaneously putting the foregoing stencils out of action.

What is claimed is:

1. A rotary screen printing machine comprising:

a frame (1);

a cylindrical stencil (2), said stencil being provided at both of its opposite ends with a ring (3), each said ring being rotatably supported in a respective first bearing (4) on said frame;

a second bearing (6), said second bearing being supported on one of said rings, a driven means (5) for imparting a rotational drive force to said ring and said stencil (2);

said driven means being movably supported upon the latter said ring by said second bearing (6);

a coupling means (9–12) for connecting and disconnecting said driven means into driving contact with the latter said ring during operating of said machine;

actuating means (13, 17) for operating said coupling means for thus rendering the drive force of the driven means (5) active or inactive for driving said cylindrical stencil for at least one full rotation of the driven means;

said coupling means (9–12), comprising a cam (11) cooperating with a recess (12) in said driven means (5);

said cam being displaceable by said actuating means (13, 17) against yielding force provided by a resilient blade (9); and said one of said rings comprising an assembly including a sleeve (7) mounted on said first bearing (4) and cooperating with said driven means (5);

said sleeve (7) forming a continuation of and being secured to said one of said rings (3);

said cam (11) being mounted on said sleeve (7) by said resilient blade (9) and being movable therewith;

said resilient blade having a curved entering face (10) rotatable into the operating path of said actuating means (13, 17) by movement of said sleeve (7);

said actuating means (13, 17) being mounted on said frame and being displaceable between two positions, an active position and an inactive position; and said actuating means cooperating in said active position with said curved entering face (10) for urging said cam (11) out of said recess (12).

2. A screen printing machine according to claim 1, wherein:

said curved entering face (10) is provided with a notch (16) which cooperates in a locking manner with a mating portion (17) of said actuating means in said active position of said actuating means for arresting the movement of said ring and said stencil.

* * * * *